US011497311B2

(12) United States Patent
Garcia et al.

(10) Patent No.: US 11,497,311 B2
(45) Date of Patent: Nov. 15, 2022

(54) RUNNER FOR DRAWER ELEMENTS MOVABLE RELATIVE TO A CARCASS OF A PIECE OF FURNITURE OR HOUSEHOLD APPLIANCE, AND PIECE OF FURNITURE OR HOUSEHOLD APPLIANCE

(71) Applicant: PAUL HETTICH GMBH & CO. KG, Kirchlengern (DE)

(72) Inventors: Oscar Garcia, San Sebastian (ES); Iker Lopetegi, Zarautz (ES)

(73) Assignee: PAUL HETTICH GMBH & CO. KG, Kirchlengern (DE)

( * ) Notice: Subject to any disclaimer, the term of this patent is extended or adjusted under 35 U.S.C. 154(b) by 42 days.

(21) Appl. No.: 17/255,623

(22) PCT Filed: Jun. 7, 2019

(86) PCT No.: PCT/EP2019/064995
§ 371 (c)(1),
(2) Date: Dec. 23, 2020

(87) PCT Pub. No.: WO2020/001958
PCT Pub. Date: Jan. 2, 2020

(65) Prior Publication Data

US 2021/0267372 A1 Sep. 2, 2021

(30) Foreign Application Priority Data

Jun. 28, 2018 (DE) ..... 10 2018 115 585.9

(51) Int. Cl.
*A47B 88/40* (2017.01)
*A47B 88/919* (2017.01)
*F21V 23/06* (2006.01)

(52) U.S. Cl.
CPC ..... *A47B 88/919* (2017.01); *A47B 88/40* (2017.01); *F21V 23/06* (2013.01); *A47B 2220/0077* (2013.01)

(58) Field of Classification Search
CPC ..... A47B 88/40; A47B 88/919; F21V 23/06
See application file for complete search history.

(56) References Cited

U.S. PATENT DOCUMENTS 6,459,571 B1 * 10/2002 Carteau ..... G06F 1/184 361/679.33
8,479,447 B2 7/2013 Liebscher et al.
(Continued)

FOREIGN PATENT DOCUMENTS

AT 010609 U1 7/2009
DE 2911442 A1 9/1980
(Continued)

OTHER PUBLICATIONS

International Search Report dated Jul. 25, 2019 in related/corresponding International Application No. PCT/EP2019/064995.
(Continued)

*Primary Examiner* — James O Hansen
(74) *Attorney, Agent, or Firm* — Patent Portfolio Builders PLLC

(57) ABSTRACT

A runner for drawer elements, in particular drawers or trays, that are movable relative to a carcass of a piece of furniture or a household appliance is provided. The runner includes a carcass rail that can be secured directly or via a carcass bracket to a carcass of the piece of furniture or the household appliance, a running rail that can be secured to the movable drawer element, and electric conductors for transmitting electrical energy to a power consumer positioned on the movable drawer element. Positioned on the carcass rail or the carcass bracket is a printed circuit board extending over the length of the carcass rail, and positioned on the running
(Continued)

rail is a contact apparatus that has at least one electrically conductive contact element which, when mounted, makes permanent electrical contact with the printed circuit board, and has a connecting element that is electrically connected to the contact element for connecting to the movable drawer element.

18 Claims, 5 Drawing Sheets

(56) References Cited

U.S. PATENT DOCUMENTS

| | | | | |
|---|---|---|---|---|
| 2008/0144293 | A1* | 6/2008 | Aksamit ..... | H05K 7/1489 29/428 |
| 2016/0150881 | A1 | 6/2016 | Weißenbach et al. | |

FOREIGN PATENT DOCUMENTS

| | | | |
|---|---|---|---|
| DE | 29880063 | U1 | 4/2000 |
| DE | 202008000195 | U1 | 4/2008 |
| DE | 102014005715 | A1 | 12/2014 |
| EP | 2910144 | A1 | 8/2015 |
| GB | 2049404 | A | 12/1980 |
| WO | 0079689 | A2 | 12/2000 |
| WO | 2009152943 | A1 | 12/2009 |
| WO | 2018165717 | A1 | 9/2018 |

OTHER PUBLICATIONS

Search Report dated Apr. 9, 2019 in related/corresponding DE Application No. 10 2018 115 585.9.

Written Opinion mailed on Jul. 25, 2019 in related/corresponding International Application No. PCT/EP2019/064995.

* cited by examiner

RUNNER FOR DRAWER ELEMENTS MOVABLE RELATIVE TO A CARCASS OF A PIECE OF FURNITURE OR HOUSEHOLD APPLIANCE, AND PIECE OF FURNITURE OR HOUSEHOLD APPLIANCE

BACKGROUND AND SUMMARY OF THE INVENTION

Exemplary embodiments of the present invention relate to a drawer runner for drawer elements, in particular drawers or trays, movable relative to a carcass of a piece of furniture or household appliance, as well as to a piece of furniture or household appliance.

AT 010 609 U1 discloses a drawer runner having a sliding contact as a conductor for transmitting electrical energy to supply an LED strip on the underside of a drawer.

A mechanical or contactless switch is used to switch the lights on or off. The lighting element is switched on when the drawer is pulled out.

Exemplary embodiments of the present invention are directed to further developing a drawer runner for drawer elements movable relative to a carcass or household appliance in such a way that the power supply is permanently available for a power consumer arranged on the movable drawer element.

The drawer runner according to the invention has a carcass rail that can be attached to the carcass of a piece of furniture or household appliance either directly or via a carcass bracket.

The drawer runner also has a running rail secured to the movable drawer element, which can be moved in the carcass rail.

The drawer runner also has a conductor for the transmission of electrical energy to a power consumer located on the drawer element.

On the carcass rail or on the carcass bracket there is a printed circuit board extending over the length of the carcass rail.

A contact apparatus having at least one electrically conductive contact element, which is permanently in electrical contact with the printed circuit board in the mounted state, and having a connecting element electrically connected to the contact element for connection to the movable drawer element, is arranged on the running rail.

With such a drawer runner arranged according to the invention, a permanent power supply to a power consumer located on the movable drawer element is made possible in a simple manner.

The printed circuit board extending over the entire length of the carcass rail always provides an electrical connection to the power consumer on the drawer element.

According to an advantageous embodiment variant of the invention, the printed circuit board is part of a fastening part made of an electrically insulating material which can be fixed to the carcass rail or to the carcass bracket.

This ensures reliable insulation of the current-carrying components, so that it is also possible to touch the carcass rail or the carcass bracket without risk when the movable drawer element is extended.

According to another embodiment variant, the contact element is designed as a contact pin mounted in a housing of the contact apparatus.

According to an alternative embodiment variant, the at least one contact element is designed as a wheel mounted in a housing of the contact apparatus, which is in contact with the printed circuit board along the printed circuit board when the movable drawer element is pulled out or pushed in together with the running rail.

In order to compensate for any height tolerances of the running rail relative to the carcass rail, the at least one contact element is spring-mounted in the contact apparatus according to a preferred embodiment variant.

This provides a simple way of pretensioning the contact element, ensuring that the contact element is always in contact with the printed circuit board.

According to another embodiment variant, the contact apparatus is detachably secured to the running rail.

This provides an easy way to repair or replace the contact apparatus or contact elements if necessary.

According to another embodiment variant, the printed circuit board is also detachably attached to the carcass rail or carcass bracket.

The printed circuit board is connected to a DC voltage source according to a preferred embodiment variant. In particular, the printed circuit board is connected to a storage battery, which opens up the possibility to provide a power supply also for drawer elements which are not positioned near a fixed voltage source.

The furniture and household appliance in accordance with the invention is characterized by a drawer runner as described above.

BRIEF DESCRIPTION OF THE DRAWING FIGURES

In the following, preferred exemplary embodiments of the invention are explained in more detail using the enclosed drawings, wherein.

DETAILED DESCRIPTION

In the following figure description, terms such as top, bottom, left, right, front, rear, etc. refer exclusively to the exemplary representation and position of the drawer runner, furniture or household appliance, running rail, carcass rail, printed circuit board, contact apparatus, fastening component and the like selected in the respective figures. These terms are not to be understood in a restrictive sense, i.e. these references may change as a result of different working positions or mirror-symmetrical design or the like.

Figure 1:
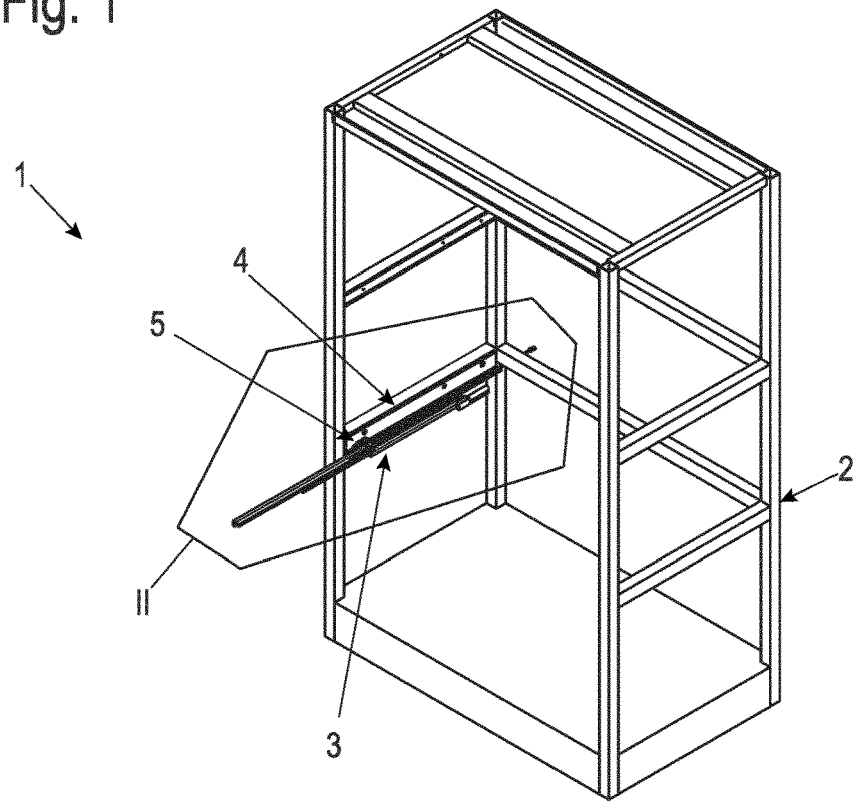
FIG. 1 shows a perspective view of an embodiment variant of a piece of furniture with a furniture carcass and an exemplary drawer runner attached thereto.
Figure 8:
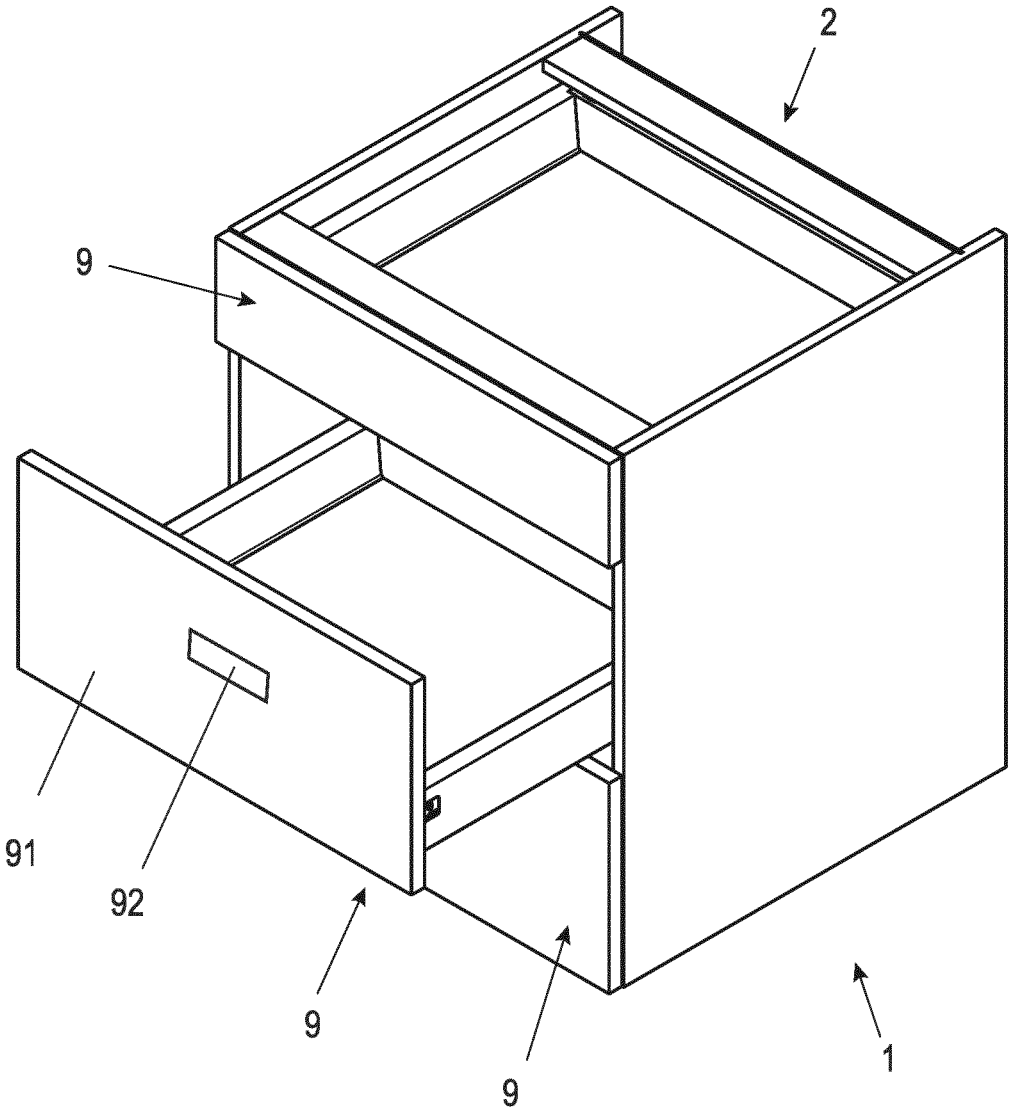
FIG. 8 shows a perspective view of an alternative embodiment variant of a piece of furniture with movable drawer elements designed as drawers and a power consumer arranged as a lighting element on a front panel of the drawer.

In FIGS. 1 and 8, the reference numerals 1 indicate alternative embodiment variants of a piece of furniture.

Each piece of furniture 1 has a carcass 2 to which one or more drawer runners 3 are attached. In the piece of furniture 1 shown in FIG. 8, drawers 9 are guided on the drawer runners 3 so that they can move via the drawer runners 3 relative to the carcass 2.

Figure 2:
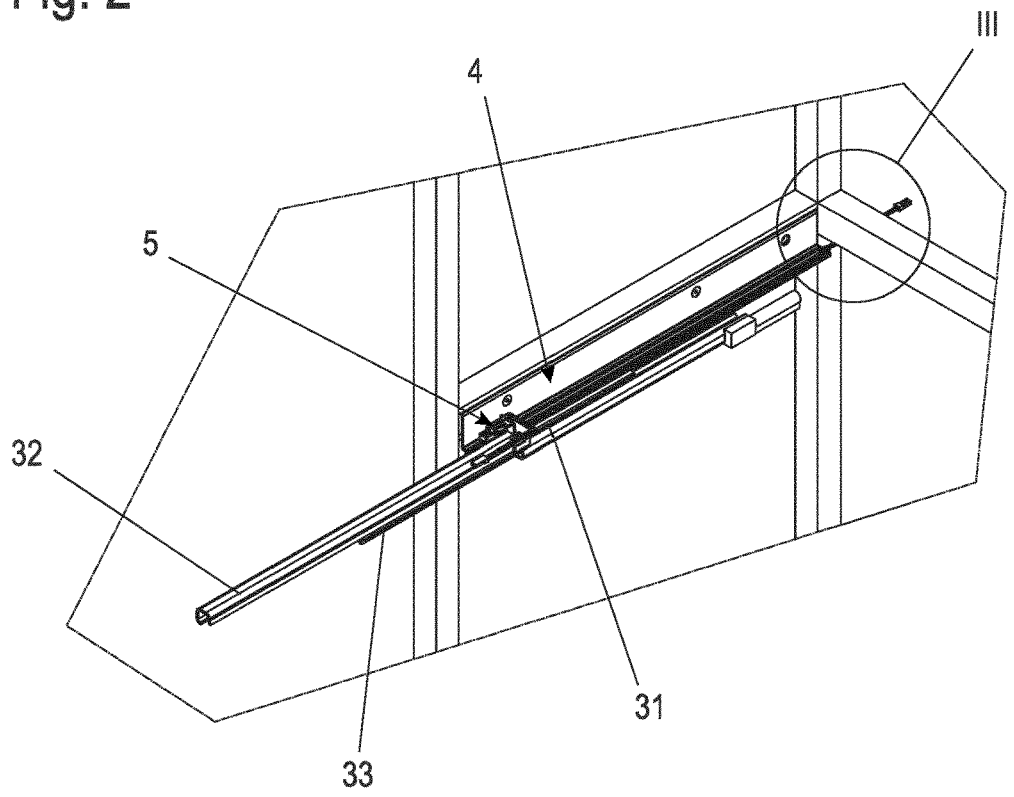
FIG. 2 shows a detailed representation of the drawer runner marked 11 in FIG. 1.
Figure 4:
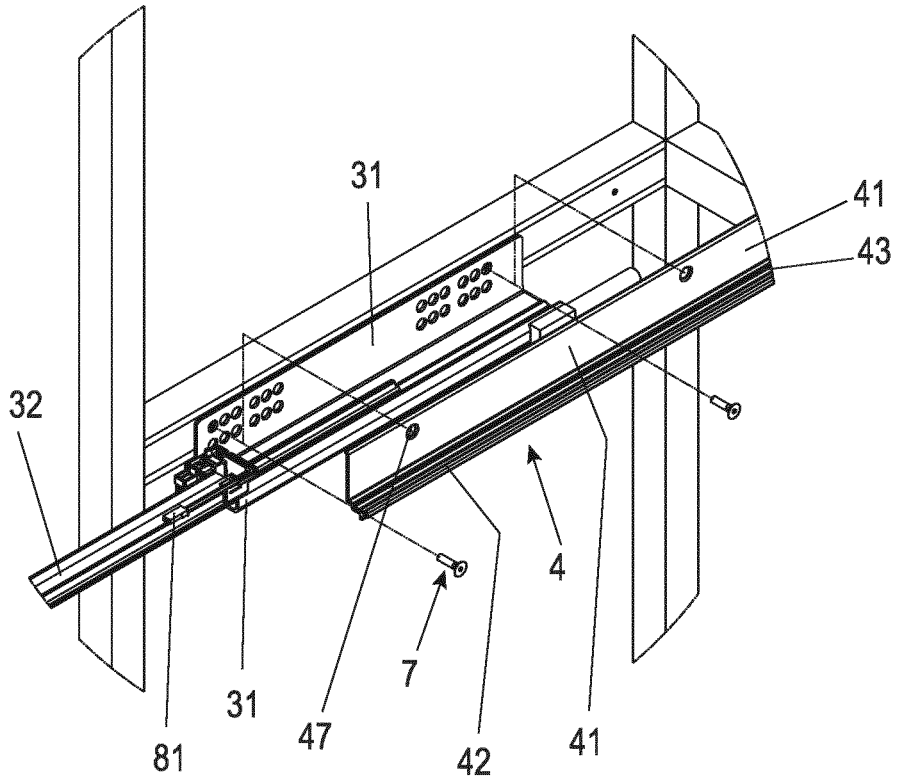
FIG. 4 shows a perspective partial exploded view of the drawer runner shown in FIG. 2 with the fastening component removed.
Figure 5:
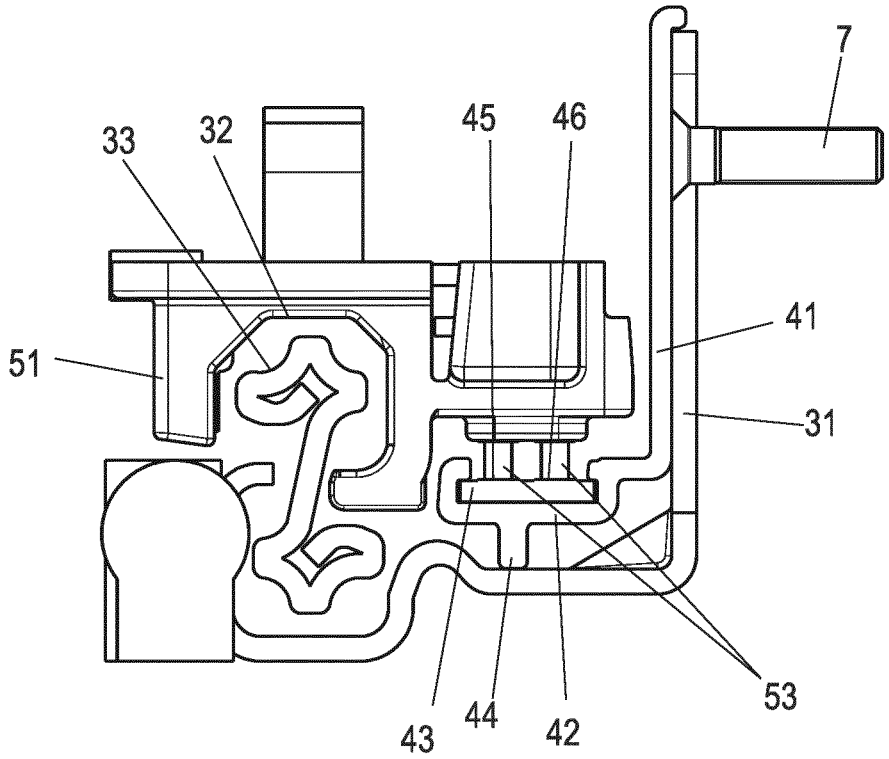
FIG. 5 shows a front view of the drawer runner.

As shown in FIGS. 2, 4 and 5, each of the drawer runners has a carcass rail 31 that can be secured to carcass 2 of the piece of furniture 1 or to a household appliance directly or via a carcass bracket.

In the embodiment variant of the drawer runner 3 shown here, the carcass rail 31 is displaceably connected to a running rail 32 via a central rail 33.

The running rail 32 is attached to the movable drawer element on a drawer as shown in the following example in FIG. 8.

To supply power to a lighting element 92 attached to a front panel 91 of drawer 9, drawer runner 1 has at least one conductor for transmitting electrical energy. As an example, the middle drawer 9 of the piece of furniture 1 shown in FIG. 8 has a front panel 91 with a corresponding lighting element 92.

Figure 3:
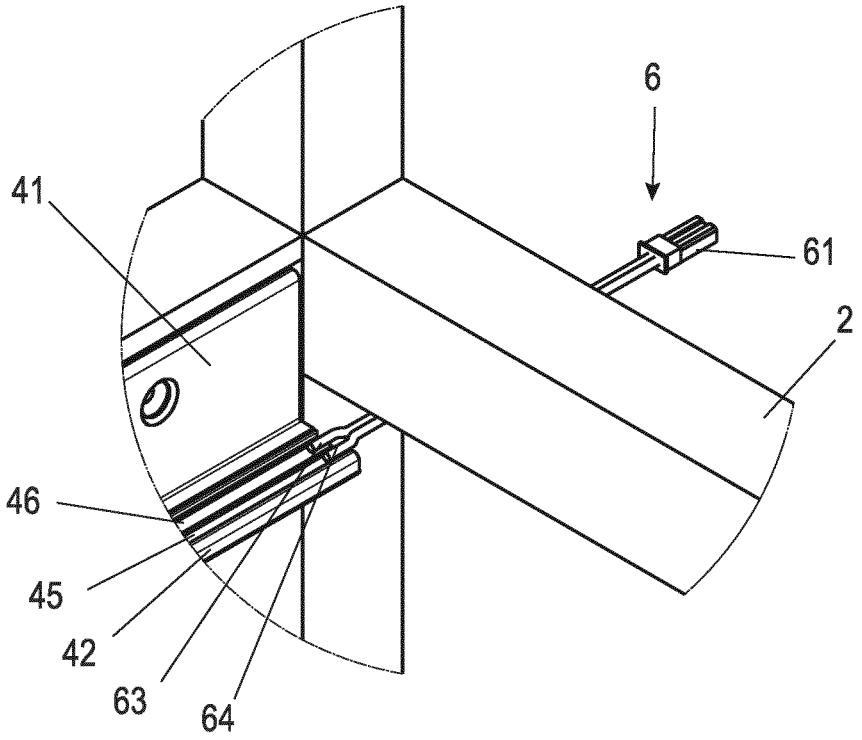
FIG. 3 shows a detail shown in FIG. 2 with III to illustrate the power supply of the printed circuit board.

As shown in FIGS. 3-5, a printed circuit board 43 extending over the length of the carcass rail 31 is arranged as a conductor on the carcass rail 31.

The printed circuit board 43 is attached to a fastening component 4 attached to the carcass 2 of the furniture or household appliance. In the embodiment variant shown here, the carcass rail 31 of the drawer runner 3 is designed integrally with a carcass bracket and fixed to a carcass 2 of the piece of furniture 1 by means of fastening elements 7, shown here as an example in the form of screws. The fastening elements 7 are simultaneously guided through corresponding recesses 47 of the fastening component 4, which means that no additional fastening elements are required.

Figure 6:
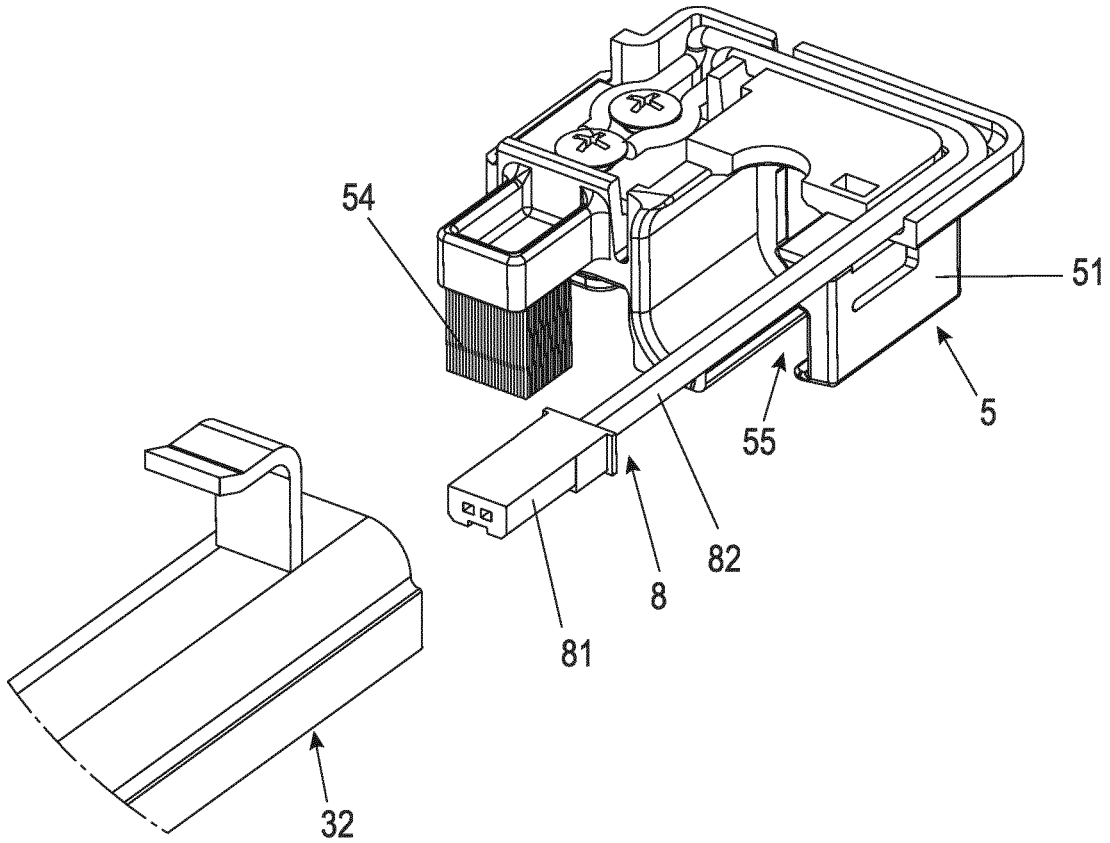
FIG. 6 shows a perspective partial exploded view of the running rail and the contact apparatus that can be attached thereto.

For the transmission of the electrical energy fed into the printed circuit board 43, a contact apparatus 5 with at least one electrically conductive contact element 53 is arranged on the running rail 32 as shown in FIGS. 5 and 6.

This contact element 53 is permanently in electrical contact with the printed circuit board 43 when assembled.

The contact element 53 can be connected to the movable drawer element via a connecting element 8. In the embodiment variant shown here, the connecting element 8 is designed as a conductor cable 82 with a plug 81 secured to one end. The end of the conductor cable 82 facing away from the plug 81 is electrically connected to the contact element(s) 53.

For the power supply of the printed circuit board 43, a first connecting element 6 is used, which in the embodiment variant shown here as a conductor cable 62 with respective cable ends 63, 64 is in electrical contact with conductor tracks 45, 46 of the printed circuit board 43 and has a plug 61 at the other end, which is connected for example to a (not shown) storage battery or another voltage source, preferably a DC voltage source.

As shown in FIGS. 4 and 5 as an example, the printed circuit board 43 is designed as part of a fastening component 4 which can be secured to the carcass rail 31 or the carcass bracket and is made of an electrically insulating material, e.g., a plastic.

As shown in FIGS. 4 and 5, the fastening component 4 has a fastening plate 41 that rests against a fastening part of the carcass rail 31 or the carcass bracket for fixing to the carcass 2 of the piece of furniture 1 or household appliance.

A printed circuit board holder 42 extends preferably perpendicularly to the fastening plate 41 and is supported at the bottom towards the carcass rail 31 by a support web 44, thus ensuring vertical stabilization of the printed circuit board 43.

For contacting the current-carrying conductor tracks 45, 46 of the printed circuit board 43, vertically extending contact elements 53 protrude downwards from a housing 51 of the contact apparatus 5 in FIG. 5.

It is also conceivable to mount wheels made of electrically conductive material on the housing 51 of the contact apparatus 5 instead of the contact pins, which roll on the conductor tracks 45, 46 of the printed circuit board 43 when the running rail 32 is moved relative to the carcass rail 31.

In order to be able to compensate for any height tolerances of the distance between the running rail 32 and the printed circuit board 43 which could lead to a loss of contact between the contact elements 53 and the conductor tracks 45, 46, the contact elements 53 in the contact apparatus 5 are resiliently pretensioned in the direction of the printed circuit board 43 and mounted so as to be vertically displaceable.

To facilitate assembly of the drawer runner 3, the contact apparatus 5 is preferably secured detachably to the running rail 32. For this purpose, the contact apparatus 5 has a running rail holder 55 according to the embodiment variant as shown in FIG. 6, into which one end of the running rail 32 can be inserted and thus holds the contact apparatus 5 to the running rail 32.

Figure 7:
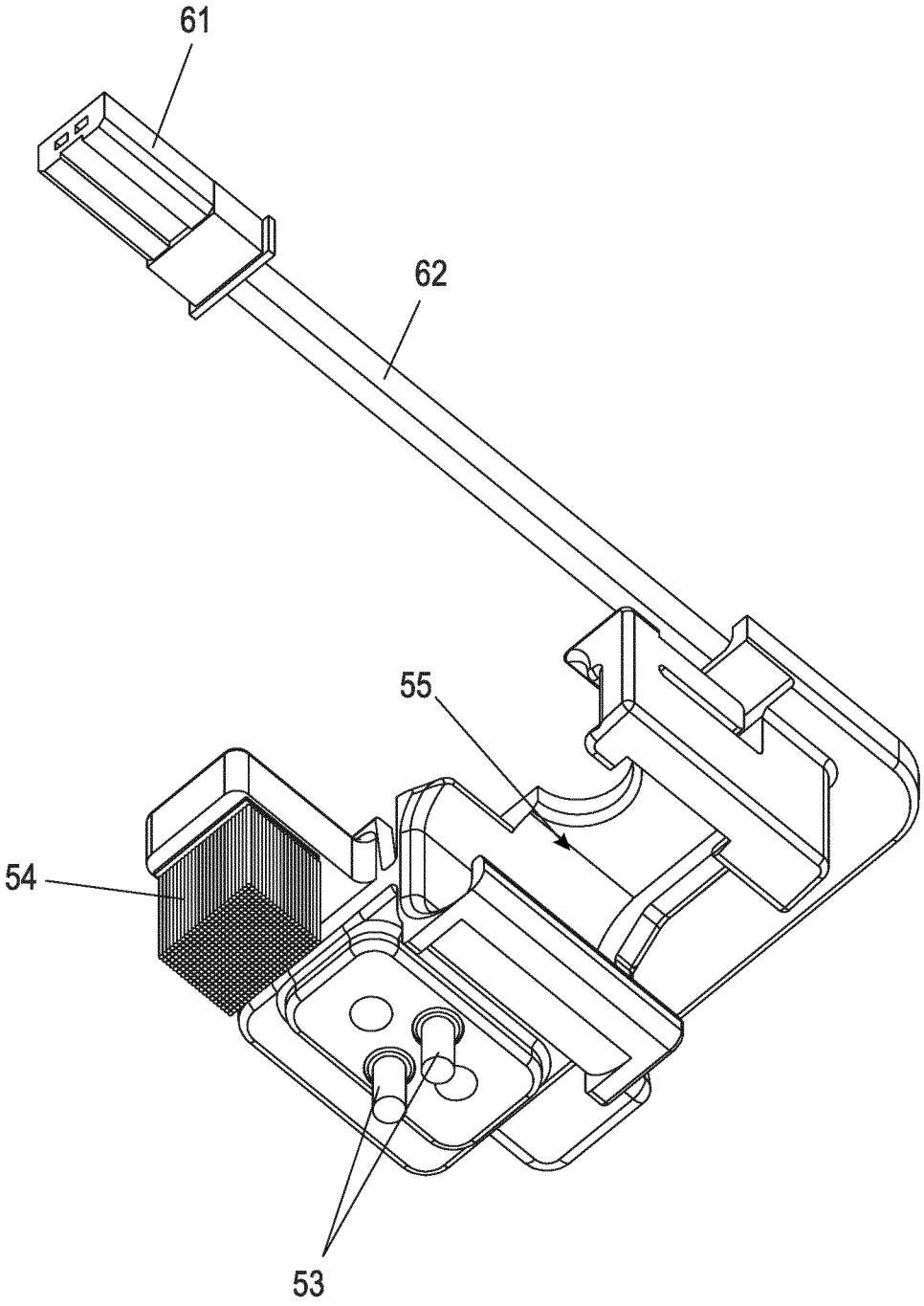
FIG. 7 shows a further perspective view of the contact apparatus from an alternative perspective to illustrate the contact elements.

In order to remove possible soiling on the printed circuit board 43, at least one brush 54 is fixed to the contact apparatus 5 in front of the contact element 53 in the direction of displacement in accordance with the embodiment variant of the contact apparatus as shown in FIGS. 6 and 7. However, the at least one brush 54 can also be fixed behind the contact element 53 or, for more thorough cleaning, both in front of and behind the contact element 53.

By mounting the printed circuit board 43 in the fastening component 4 in the exemplary embodiment shown in FIG. 4, the printed circuit board 43 is also detachably secured to the carcass rail 31, which also allows easy retrofitting of a drawer runner 3 with such a printed circuit board 43.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Piece of furniture
2 Carcass
3 Drawer runner
31 Carcass rail
32 Running rail
33 Central rail

4 Fastening component
41 Fastening plate
42 Printed circuit board holder
43 Printed circuit board
44 Support web
45 Conductor track
46 Conductor track
47 Recess
5 Contact apparatus
51 Housing
53 Contact element
54 Brush
55 Running rail holder
6 First connecting element
61 Plug
62 Conductor cable
63 Cable end
64 Cable end
7 Fastening element
8 Second connecting element
81 Plug
82 Conductor cable
83 Cable end
84 Cable end
9 Drawer
91 Front panel
92 Lighting element

The invention claimed is:

1. A drawer runner for a moveable drawer element, wherein the drawer runner is movable relative to a carcass of a piece of furniture or household appliance, the drawer runner comprising:

a carcass rail configured for securing to a carcass of the piece of furniture or household appliance;

a running rail configured for securing to the movable drawer element and moveable, either directly or via a central rail, relative to the carcass rail;

at least one conductor track configured to transmit electrical energy to as power consumer arranged on the movable drawer element;

a printed circuit board, extending over an entire length of the carcass ran, arranged on the carcass rail;

and a contact apparatus having at least one electrically conductive contact element arranged on the running rail, wherein, in a mounted state, the contact apparatus is permanently in electrical contact with the printed circuit board and a connecting element is electrically connected to the at least one electrically conductive contact element for connection to the movable drawer element, wherein the contact apparatus has a running rail holder detachably securing the contact apparatus to the running rail, and wherein, in the mounted state, the running rail passes through the running rail holder.

2. The drawer runner of claim 1, wherein the printed circuit board is part of a fastening component made of an electrically insulating material which is fixable to the carcass rail.

3. The drawer runner of claim 2, the fastening component with the printed circuit board is detachably secured to the carcass rail.

4. The drawer runner of claim 1, wherein the at least one electrically conductive contact element is a contact pin mounted in a housing of the contact apparatus.

5. The drawer runner of claim 1, wherein the at least one electrically conductive contact element is a wheel mounted in a housing of the contact apparatus.

6. The drawer runner of claim 1, wherein the at least one electrically conductive contact element is resiliently mounted in the contact apparatus.

7. A drawer runner of claim 1, further comprising:

at least one brush fixed to the contact apparatus in front of or behind the at least one electrically conductive contact element in a direction of displacement of the drawer runner.

8. The drawer runner of claim 1, wherein the printed circuit board is connected to a DC voltage source.

9. The drawer runner of claim 8, wherein the DC voltage source is a storage battery.

10. A piece of furniture or household appliance, comprising:

a carcass;

at least one drawer runner;

a drawer element, which is mounted movably relative to the carcass via the at least one drawer runner, wherein the at least one drawer runner comprises a carcass rail configured for securing to a carcass of the piece of furniture or household appliance;

a running rail configured for securing to the movable drawer element and moveable, either directly or via a central rail, relative to the carcass ran;

at least one conductor track configured to transmit electrical energy to a power consumer arranged on the movable drawer element;

a printed circuit board, extending over an entire length of the carcass ran, arranged on the carcass rail;

and a contact apparatus having at least one electrically conductive contact element arranged on the running rail, wherein, in a mounted state, the contact apparatus is permanently in electrical contact with the printed circuit board and a connecting element is electrically connected to the at least one electrically conductive contact element for connection to the movable drawer element, wherein the contact apparatus has a running rail holder detachably securing the contact apparatus to the running rail, and wherein, in the mounted state, the running rail passes through the running rail holder.

11. The piece of furniture or household appliance of claim 10, wherein the printed circuit board is part of a fastening component made of an electrically insulating material which is fixable to the carcass rail.

12. The piece of furniture or household appliance of claim 11, the fastening component with the printed circuit board is detachably secured to the carcass rail.

13. The piece of furniture or household appliance of claim 10, wherein the at least one electrically conductive contact element is a contact pin mounted in a housing of the contact apparatus.

14. The piece of furniture or household appliance of claim 10, wherein the at least one electrically conductive contact element is a wheel mounted in a housing of the contact apparatus.

15. The piece of furniture or household appliance of claim 10, wherein the at least one electrically conductive contact element is resiliently mounted in the contact apparatus.

16. The piece of furniture or household appliance of claim 10, further comprising:

at least one brush fixed to the contact apparatus in front of or behind the at least one electrically conductive contact element in a direction of displacement of the drawer runner.

17. The piece of furniture or household appliance of claim 10, wherein the printed circuit board is connected to a DC voltage source.

18. The piece of furniture or household appliance of claim 17, wherein the DC voltage source is a storage battery.

* * * * *